US012589422B2

(12) United States Patent
Hoshino

(10) Patent No.: US 12,589,422 B2
(45) Date of Patent: Mar. 31, 2026

(54) MEANDERING AMOUNT DETECTION METHOD AND MEANDERING CONTROL METHOD FOR METAL STRIP

(71) Applicant: JFE Steel Corporation, Tokyo (JP)

(72) Inventor: Masanori Hoshino, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 398 days.

(21) Appl. No.: 18/033,588

(22) PCT Filed: Jul. 8, 2021

(86) PCT No.: PCT/JP2021/025757
§ 371 (c)(1),
(2) Date: Apr. 25, 2023

(87) PCT Pub. No.: WO2022/091487
PCT Pub. Date: May 5, 2022

(65) Prior Publication Data

US 2023/0390817 A1 Dec. 7, 2023

(30) Foreign Application Priority Data

Oct. 29, 2020 (JP) ..... 2020-181179

(51) Int. Cl.
*B21B 37/68* (2006.01)
*B21B 39/14* (2006.01)

(52) U.S. Cl.
CPC ..... *B21B 37/68* (2013.01); *B21B 39/14* (2013.01)

(58) Field of Classification Search
CPC ... B21B 37/66; B21B 39/084; B21B 2273/04; B21B 37/00; B21B 37/78; B21B 39/00;
(Continued)

(56) References Cited

U.S. PATENT DOCUMENTS 7,668,491 B2 * 2/2010 Furuya ..... G03G 15/1615 399/302
8,038,148 B2 * 10/2011 Fuwa ..... B65H 23/038 271/227

(Continued)

FOREIGN PATENT DOCUMENTS

CN 203461586 U 3/2014
CN 206347974 U * 7/2017

(Continued)

OTHER PUBLICATIONS

International Search Report dated Aug. 10, 2021, of corresponding International Application No. PCT/JP2021/025757 along with an English translation.

(Continued)

*Primary Examiner* — Yongjia Pan
(74) *Attorney, Agent, or Firm* — DLA Piper LLP (US)

(57) ABSTRACT

A meandering amount detection method for a metal strip that detects a meandering amount of a metal strip traveling in a state of being overlapped in a plurality of stages at intervals, the meandering amount detection method includes: measuring a distance from a mounting position of a distance meter in a direction intersecting a width direction of a metal strip, using a plurality of distance meters provided side by side in the width direction of the metal strip on at least one side in a width direction of the metal strips overlapped in the plurality of stages; and detecting a stage of a metal strip in which meandering occurs and a meandering amount, using the mounting position of a distance meter and the measurement value.

2 Claims, 5 Drawing Sheets

(58) Field of Classification Search
CPC ..... B21B 39/14; B21B 37/68; B21B 38/00; B21C 47/3425; B21C 51/00; B21C 49/00
See application file for complete search history.

(56) References Cited

U.S. PATENT DOCUMENTS

| | | | | |
|---|---|---|---|---|
| 10,029,493 | B2 * | 7/2018 | Kamigiku | B65H 23/0204 |
| 10,053,322 | B2 * | 8/2018 | Sato | B65H 23/038 |
| 11,833,560 | B2 * | 12/2023 | Goto | B21B 37/68 |
| 2013/0043415 | A1 | 2/2013 | Misao | |
| 2017/0259313 | A1 * | 9/2017 | Fairlie | B21B 37/28 |
| 2017/0326605 | A1 * | 11/2017 | Yamasaki | B21B 37/76 |
| 2020/0082550 | A1 * | 3/2020 | Sakai | G06T 7/0006 |

FOREIGN PATENT DOCUMENTS

| | | | | | |
|---|---|---|---|---|---|
| CN | 108217267 | A | * | 6/2018 | B65H 23/0326 |
| CN | 207759771 | U | | 8/2018 | |
| JP | S6338201 | Y2 | * | 10/1988 | |
| JP | S63248507 | A | * | 10/1988 | |
| JP | H05239556 | A | * | 9/1993 | |
| JP | 6-265314 | | | 9/1994 | |
| JP | H06265314 | A | * | 9/1994 | |
| JP | 2953274 | B2 | | 9/1999 | |
| JP | H11281345 | A | | 10/1999 | |
| JP | 2000298519 | A | * | 10/2000 | |
| JP | 3308757 | B2 | | 7/2002 | |
| JP | 2006-346715 | | | 12/2006 | |
| JP | 2011042838 | A | * | 3/2011 | |
| JP | 2012121032 | A | | 6/2012 | |
| JP | 2012-223771 | | | 11/2012 | |
| JP | 2012240067 | A | * | 12/2012 | |
| JP | 2013-040038 | | | 2/2013 | |
| JP | 2014-231432 | | | 12/2014 | |
| JP | 5742487 | B2 | * | 7/2015 | |
| JP | 2017-192943 | | | 10/2017 | |
| JP | 6384510 | B2 | * | 9/2018 | |

OTHER PUBLICATIONS

Extended European Search Report dated Dec. 5, 2023, of counterpart European Patent Application No. 21885610.2.
Office Action dated Aug. 9, 2025, from counterpart Chinese Patent Application No. 202180072941.4.

* cited by examiner

MEANDERING AMOUNT DETECTION METHOD AND MEANDERING CONTROL METHOD FOR METAL STRIP

TECHNICAL FIELD

This disclosure relates to a meandering amount detection method and a meandering control method for a metal strip.

BACKGROUND

In general, a treatment line for a metal strip such as a steel plate is constituted of an entry side section for performing delivery, welding and others of the metal strip, a central section for performing annealing, rolling, pickling and others on the metal strip, and an exit side section for performing winding and cutting of the metal strip. Each of the sections is provided with a plurality of rolls for performing support of plate passing, tension control, and others, and a metal strip passes over the rolls and undergoes a series of processes from the entry side to the exit side. This series of processes is referred to as plate passing.

To keep the quality of a metal strip constant by making the plate passing speed in the central section constant, a storing and delivering device for a metal strip called a looper is provided between each of the entry side section, the central section, and the exit side section. The looper includes a fixed roll and a looper car, and the further the looper car is from the fixed roll, the more a metal strip is stored. Typically, to increase the storage amount of a metal strip, the looper is in a state in which a metal strip is overlapped in a plurality of stages at intervals in the longitudinal direction or the lateral direction.

A metal strip may be displaced from the center position in the width direction of the roll toward the end portion in the width direction during plate passing due to factors such as wear of the roll and the shape of the metal strip. This phenomenon is called meandering. When the meandering amount of a metal strip increases, there is a possibility that equipment may be damaged due to contact between peripheral equipment and the metal strip or the metal strip may be broken due to a sudden change in tension, and there is a concern about a significant production loss. In view of such a background, a technique for controlling a meandering amount of a metal strip has been proposed.

Specifically, a center position control (CPC) device is known as a general meandering control device, and the CPC device includes a meandering detector and a meandering correction operation mechanism (hereinafter referred to as a steering roll). Examples of the meandering detector include a pair of a light projector and a light receiver, and an automatic width control (AWC), and examples of the meandering correction operation mechanism include a roll tilting mechanism. The meandering detector detects a width-direction position of a metal strip. The CPC device calculates a deviation between a detection value of the meandering detector and a target position and operates to reduce the deviation by controlling the meandering correction operation mechanism.

JP 2014-231432 A describes a method of improving a meandering correction capability by reducing a tension of a steel plate in a looper with respect to a function of detecting the meandering of the steel plate using a light projector and correcting the meandering of the steel plate by tilting a steering roll. JP 2006-346715 A describes a device and a method in which split rolls are provided in the width direction of a steel plate, reaction forces from the steel plate acting on both end portions of the split rolls are detected, and the meandering amount of the steel plate is calculated. JP 2013-40038 A describes a method of detecting the position of a sheet end portion using a plurality of light projectors and light receivers.

However, a looper car travels in a looper, and it is not possible to install devices such as a light projector and receiver and an AWC in a traveling passage of the looper car. Therefore, it is difficult to perform meandering control of a metal strip in the looper using a CPC device. On the other hand, in the method described in JP 2014-231432 A, since a light projector is used, there is a restriction that the meandering of the metal strip on the fixed roll side can only be detected. In the method described in JP 2006-346715 A, a large number of devices such as a split roll, a support shaft, and a pressure detector are required, which increases the installation space and the cost for the devices. In the method described in JP 2013-40038 A, in a place where metal strips are present in a plurality of stages such as in a looper, it is not possible to detect which metal strip meanders, and it is not possible to determine which steering roll is to be tilted.

It could therefore be helpful to provide a meandering amount detection method for a metal strip that is capable of detecting a meandering amount of a metal strip in a looper, in any stage, in a space-saving and cost-saving manner, as well as a meandering control method for a metal strip that is capable of detecting a meandering amount of a metal strip in a looper, in any stage, in a space-saving and cost-saving manner and correcting the meandering of the metal strip.

SUMMARY

I thus provide a meandering amount detection method for a metal strip that is a method that detects a meandering amount of a metal strip traveling in a state of being overlapped in a plurality of stages at intervals, the meandering amount detection method including: a step of measuring a distance from a mounting position of a distance meter in a direction intersecting a width direction of a metal strip, using a plurality of distance meters provided side by side in the width direction of the metal strip on at least one side in a width direction of the metal strips overlapped in the plurality of stages, and detecting a stage of a metal strip in which meandering occurs and a meandering amount, using the mounting position of a distance meter and the measurement value.

Moreover, a meandering control method for a metal strip includes a step of controlling meandering of a metal strip based on a meandering amount of the metal strip detected by using the meandering amount detection method for the metal strip.

Moreover, the meandering control method for a metal strip includes a step of correcting meandering of a metal strip in another stage when meandering of a metal strip in another stage is detected after meandering of a metal strip in a stage in which meandering is detected is corrected.

My meandering amount detection method for a metal strip can detect a meandering amount of a metal strip in a looper, in any stage, in a space-saving and cost-saving manner. According to the meandering control method for a metal strip, the meandering amount of the metal strip in the looper can be detected in any stage in a space-saving and cost-saving manner, and the meandering of the metal strip can be corrected.

REFERENCE SIGNS LIST

1 LOOPER
2, 2*a*, 2*b*, 2*c*, 2*d* METAL STRIP
3 STEERING ROLL
4 LOOPER CAR
10 MEANDERING CONTROL DEVICE FOR METAL STRIP
11, 11_1, 11_2, 11_3, 11_*n* DISTANCE METER
12 MEANDERING DETECTOR
13 CONTROL DEVICE

DETAILED DESCRIPTION

A configuration of a meandering control device for a metal strip, which is an example, will be described below with reference to the drawings.

Configuration of Looper

A configuration of a looper to which a meandering control device for a metal strip, which is an example, is applied will be first described with reference to FIG. 1.

Figure 1:
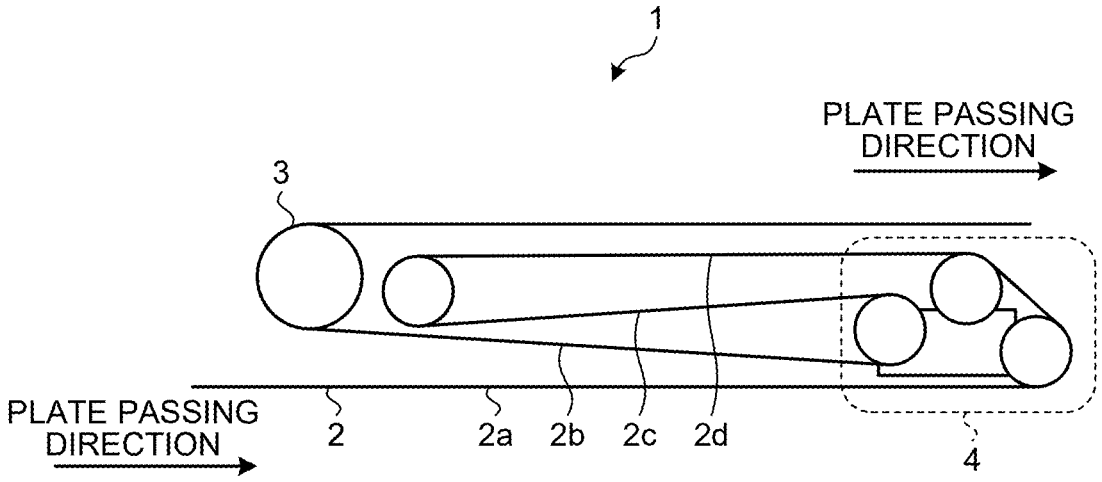
FIG. 1 is a side view illustrating a configuration of a looper to which a meandering control device for a metal strip, which is an example, is applied.

FIG. 1 is a side view illustrating a configuration of a looper to which a meandering control device for a metal strip is applied. As illustrated in FIG. 1, in a looper 1 to which a meandering control device for a metal strip is applied, a metal strip 2 is passed through to reciprocate between a steering roll 3 and a looper car 4. Therefore, metal strips 2 (2*a*, 2*b*, 2*c*, and 2*d*) in a plurality of stages are present at intervals in the looper 1. In this example, the meandering control device for a metal strip detects the meandering amount of the metal strip 2 in the looper 1, in any stage, in a space-saving and cost-saving manner, and corrects the meandering of the metal strip 2.

Configuration of Meandering Control Device for Metal Strip

A configuration of a meandering control device for a metal strip will now be described with reference to FIGS. 2 and 3.

Figure 2:
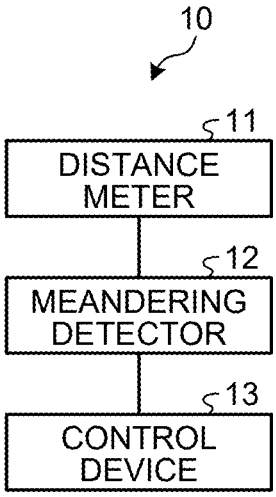
FIG. 2 is a block diagram illustrating a configuration of a meandering control device for a metal strip, which is an example.

FIG. 2 is a block diagram illustrating a configuration of a meandering control device for a metal strip. As illustrated in FIG. 2, a meandering control device 10 for a metal strip includes n (n≥2) distance meters 11, a meandering detector 12, and a control device 13.

Figure 3:
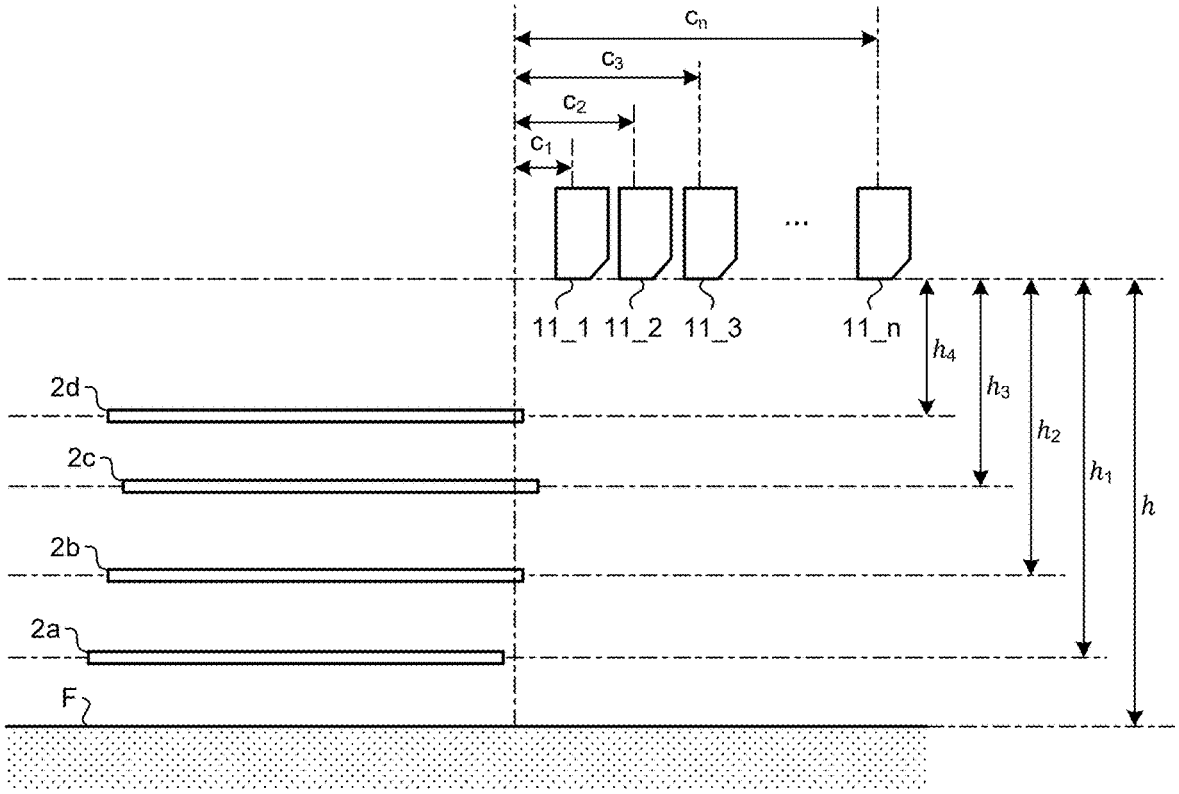
FIG. 3 is a diagram explaining parameters detected by a distance meter illustrated in FIG. 2.

As illustrated in FIG. 3, the distance meter 11 is constituted by one-dimensional distance meters provided side by side in the width direction of the metal strip 2 on at least one side in the width direction of the metal strips 2 overlapped in a plurality of stages. The distance meter 11 detects values of parameters h and l, and outputs electric signals indicating the detection values to the meandering detector 12. The parameter h indicates the height of the distance meter 11 (11_*j* (j=1 to n)) from a ground F, and the parameter l indicates the measurement value of the distance meter 11 (11_*j* (j=1 to n)). Note that, in the drawing, $C_j$ (j=1 to n) indicates a width-direction mounting position of the distance meter 11. The mounting position of the distance meter 11 is changed according to the meandering amount of the metal strip 2 acceptable by a user, and the fineness of the control amount can be determined by the number of distance meters 11. By setting the distance meters 11 on both the load side and the anti-load side in the width direction of the metal strip 2, meandering of the metal strip 2 in either direction can be detected.

The meandering detector 12 detects a meandering amount $s_i$ of the metal strip 2 in the i-th (in this example, Ii=1 to 4) stage based on the electric signal output from the distance meter 11, and outputs an electric signal indicating the detected meandering amount $s_i$ to the control device 13.

The control device 13 performs control so that the meandering amount $s_i$ of the metal strip 2 in the i-th stage detected by the meandering detector 12 falls within a predetermined range. Specifically, the control device 13 corrects the meandering of the metal strip 2 in the i-th stage by tilting the steering roll directly connected to the metal strip 2 in the i-th stage.

A meandering amount detection method and a meandering control method for the metal strip 2 by the meandering detector 12 and the control device 13 will be described below in detail with reference to FIGS. 4 to 10.

Figure 4:
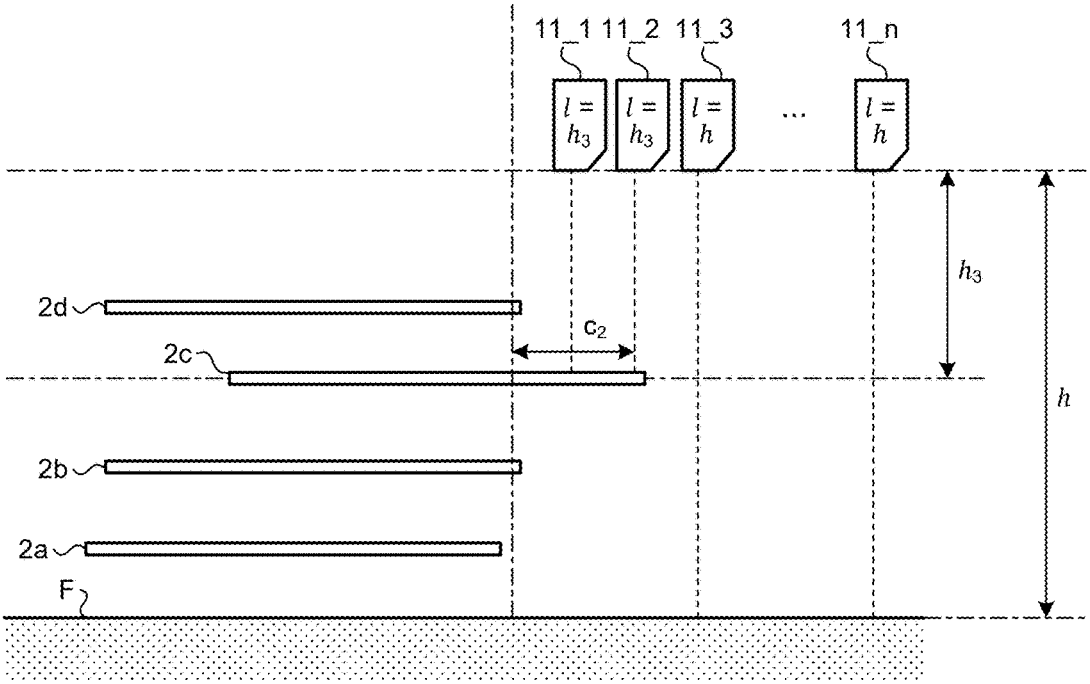
FIG. 4 is a diagram explaining a meandering control method for a metal strip, which is an example.
Figure 5:
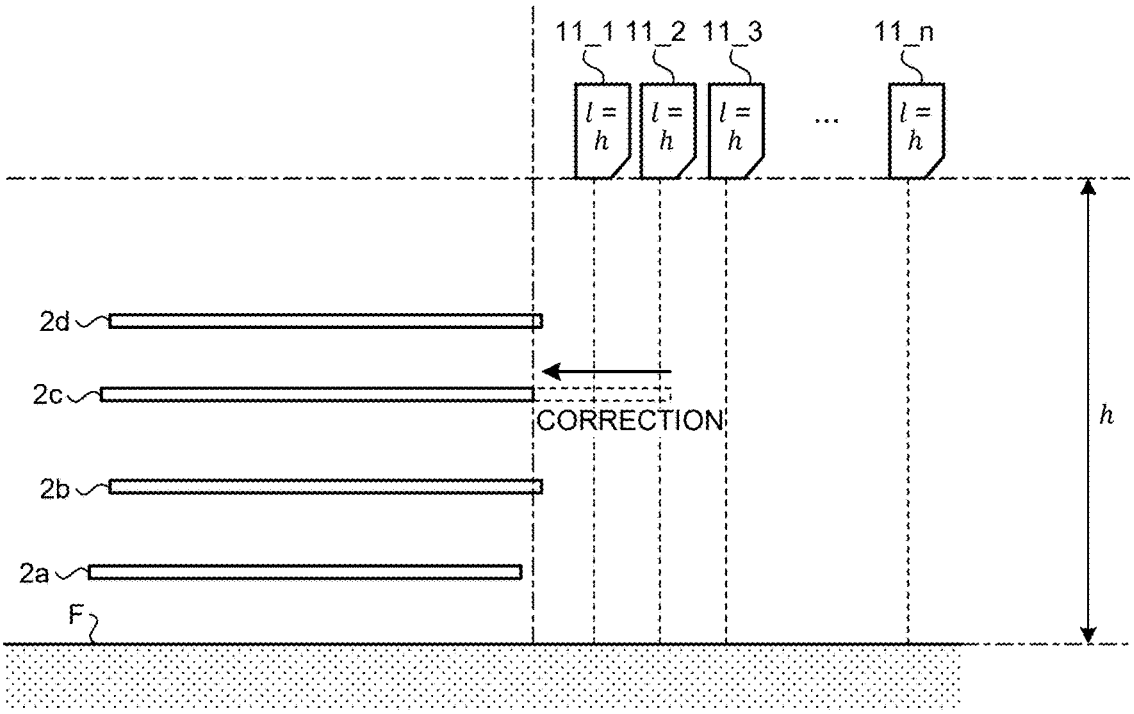
FIG. 5 is a diagram explaining a meandering control method for a metal strip, which is an example.

As illustrated in FIG. 4, it is first assumed that only the metal strip 2*c* meanders. In this example, the measurement values 1 of the distance meter 11_1 and the distance meter 11_2 are $h_3$, and the measurement value 1 of the distance meter 11_3 is h. Thus, the meandering detector 12 determines that no meandering occurs in the metal strip 2*d* and that the meandering amount $c_2$ corresponding to the width-direction mounting position of the distance meter 11_2 occurs in the metal strip 2*c*. Therefore, the control device 13 corrects the meandering of the metal strip 2*c* by tilting the steering roll directly connected to the metal strip 2*c* so that the meandering amount $c_2$ of the metal strip 2*c* is corrected. As a result, as illustrated in FIG. 5, the measurement values 1 of all the distance meters 11 become h, and it is detected that no meandering occurs in any of the metal strips 2*a* to 2*d*.

Figure 6:
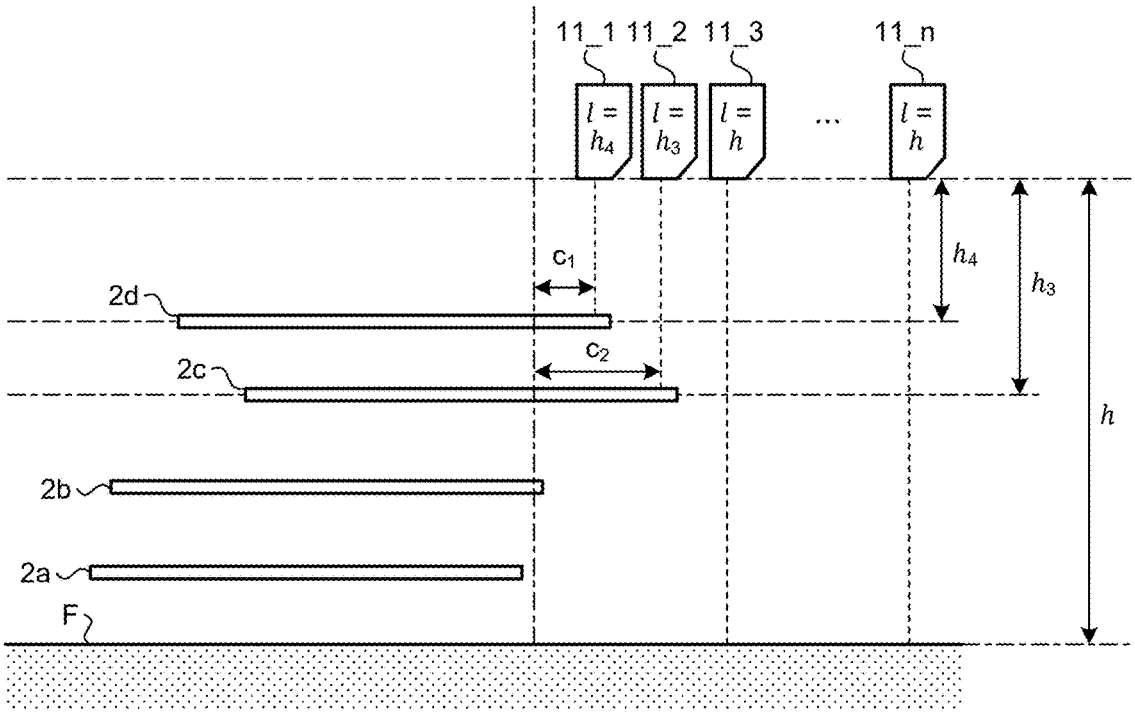
FIG. 6 is a diagram explaining a meandering control method for a metal strip, which is an example.
Figure 7:
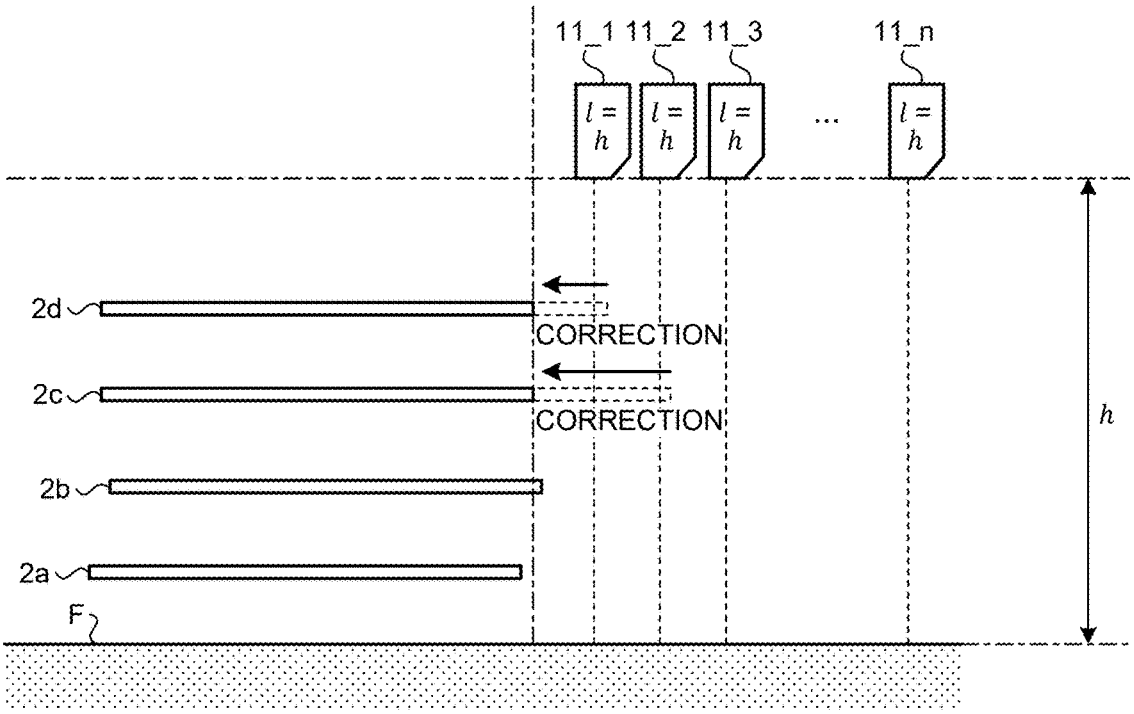
FIG. 7 is a diagram explaining a meandering control method for a metal strip, which is an example.

As illustrated in FIG. 6, it is then assumed that a plurality of metal strips (e.g., metal strip 2*c* and metal strip 2*d*) meanders, and that each meandering can be detected. In this example, the measurement value 1 of the distance meter 11_1 is $h_4$, the measurement value 1 of the distance meter 11_2 is $h_3$, and the measurement value 1 of the distance meter 11_3 is h. Thus, the meandering detector 12 determines that the meandering amount $c_1$ corresponding to the width-direction mounting position of the distance meter 11_1 is generated in the metal strip 2*d* and that the meandering amount $c_2$ corresponding to the width-direction mounting position of the distance meter 11_2 is generated in the metal strip 2*c*. Therefore, the control device 13 corrects the meandering of the metal strip 2*d* by tilting the steering roll directly connected to the metal strip 2*d* so that the meandering amount of each of the metal strip 2*d* and the metal strip 2*c* is corrected, while the control device corrects the meandering of the metal strip 2*c* by tilting the steering roll directly connected to the metal strip 2*c*. As a result, as illustrated in FIG. 7, the measurement values 1 of all the distance meters become h, and it is detected that no meandering occurs in any of the metal strips 2*a* to 2*d*.

Figure 8:
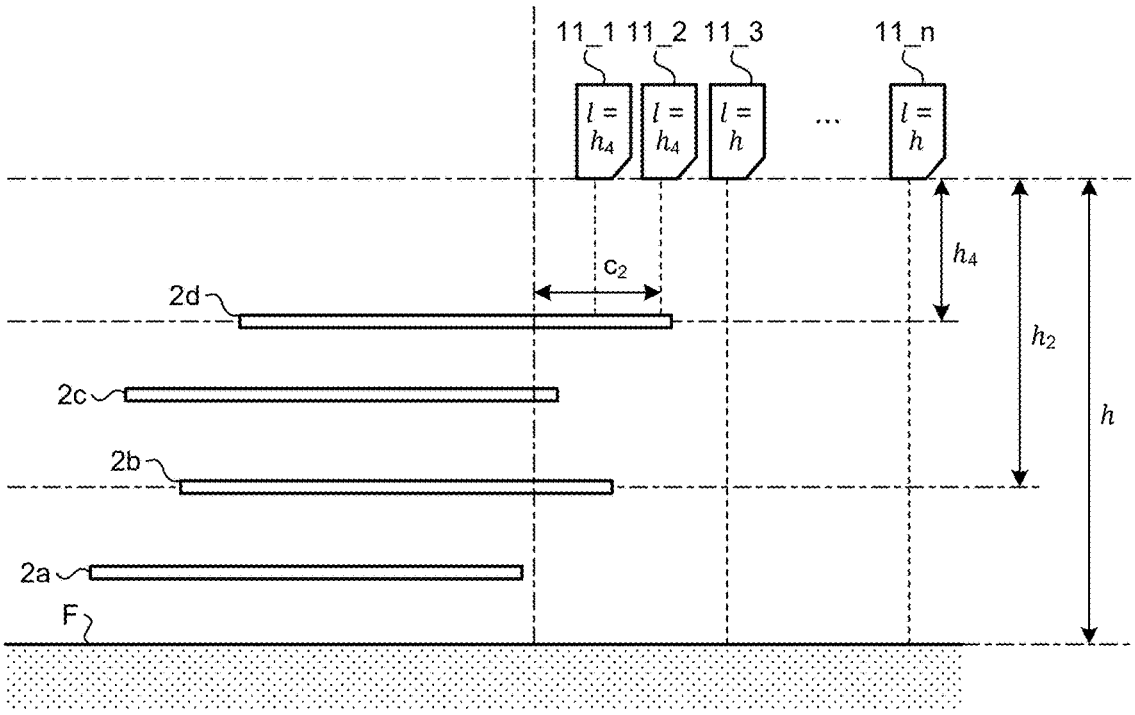
FIG. 8 is a diagram explaining a meandering control method for a metal strip, which is an example.
Figure 9:
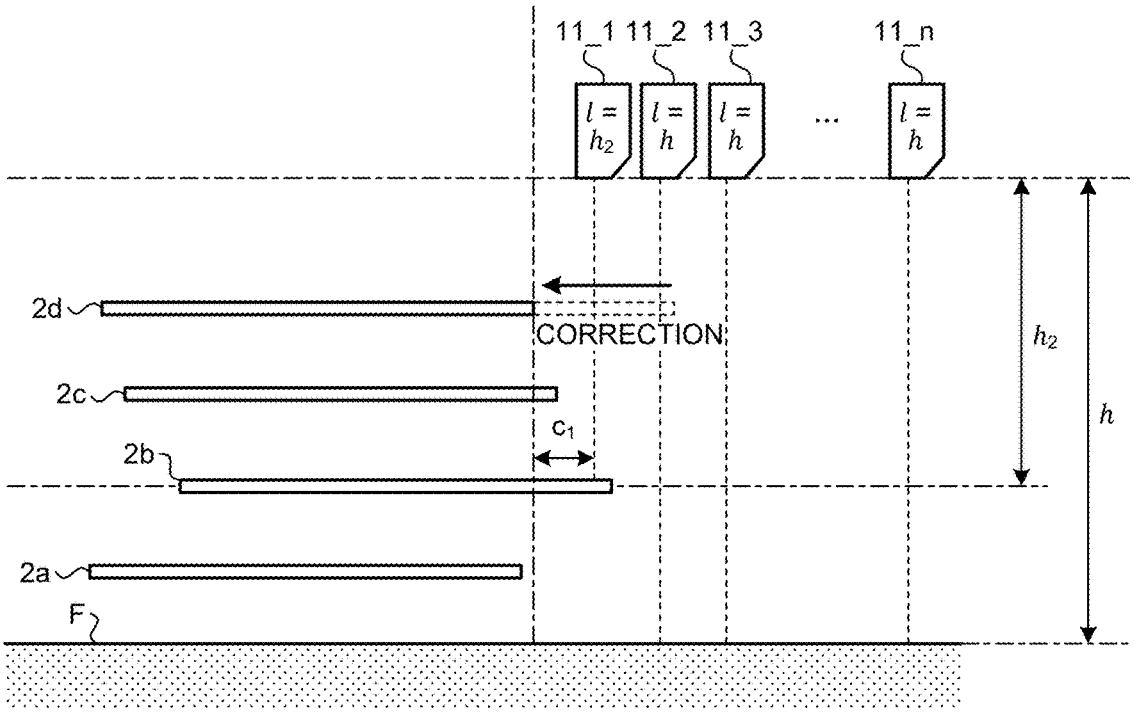
FIG. 9 is a diagram explaining a meandering control method for a metal strip, which is an example.
Figure 10:
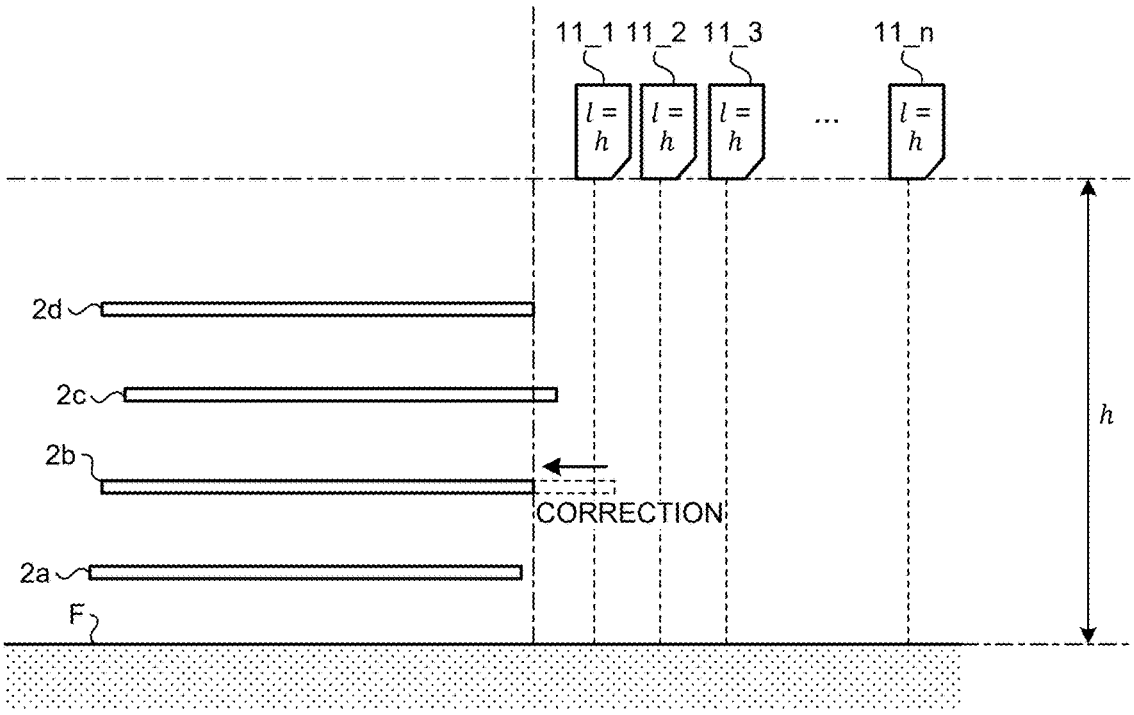
FIG. 10 is a diagram explaining a meandering control method for a metal strip, which is an example.

As illustrated in FIG. 8, it is lastly assumed that, although a plurality of metal strips (e.g., metal strip 2*b* and metal strip 2*d*) meanders, only a part of the meandering is detected. In this example, the measurement values 1 of the distance meters 11_1 and 11_2 are $h_4$, and the measurement value 1 of the distance meter 11_3 is h. Thus, the meandering detector 12 determines that the meandering amount $c_2$ corresponding to the width-direction mounting position of the distance meter 11_2 is generated in the metal strip 2*d*. Therefore, the control device 13 corrects the meandering of the metal strip 2*d* by tilting the steering roll directly connected to the metal strip 2*d* so that the meandering amount of the metal strip 2*d* is corrected. As a result, as illustrated in FIG. 9, the measurement value 1 of the distance meter 11_1 becomes $h_2$, and the measurement values 1 of the distance meters 11_2 and 11_3 become h. Thus, the meandering detector 12 determines that no meandering occurs in the metal strips 2*c* and 2*d* and that the meandering amount $c_1$ corresponding to the mounting position of the distance meter 11_1 occurs in the metal strip 2*b*. Therefore, the control device 13 corrects the meandering of the metal strip 2*d* by tilting the steering roll directly connected to the metal strip 2*b* so that the meandering amount of the metal strip 2*b* is corrected. As a result, as illustrated in FIG. 10, the measurement values 1 of all the distance meters become h, and it is detected that no meandering occurs in any of the metal strips 2*a* to 2*d*.

Although examples have been described above, this disclosure is not limited by the description and the drawings constituting a part of the disclosure according to the examples. For example, since my methods are characterized by being used in a place where metal strips are overlapped in a plurality of stages, they can also be applied to a place other than a looper (e.g., the vicinity of a joining portion of metal strips when a plurality of metal strip delivery devices is provided). As described above, other configurations, examples, operation techniques, and others implemented by those skilled in the art and others based on the examples are all included in the scope of this disclosure.

INDUSTRIAL APPLICABILITY

I made it possible to provide a meandering amount detection method for a metal strip that is capable of detecting a meandering amount of a metal strip in a looper, in any stage, in a space-saving and cost-saving manner. It is possible to provide a meandering control method for a metal strip, which is capable of detecting a meandering amount of a metal strip in a looper, in any stage, in a space-saving and cost-saving manner and correcting the meandering of the metal strip.

The invention claimed is:

1. A meandering control method for a metal strip, comprising controlling meandering of the metal strip based on a meandering amount of the metal strip detected by measuring a distance from a mounting position of a distance meter in a direction intersecting a width direction of the metal strip, using a plurality of distance meters provided side by side in the width direction of the metal strip on at least one side in the width direction of the metal strip overlapped in a plurality of stages; and detecting a stage of the metal strip in which meandering occurs and a meandering amount, using the mounting position of the plurality of distance meters and a measurement value of a distance meter of the plurality meters.

2. The method according to claim 1, comprising correcting meandering of the metal strip in another stage when meandering of the metal strip in another stage is detected after meandering of the metal strip in a stage in which meandering is detected is corrected.

* * * * *